US010571837B2

(12) United States Patent
Yamaguchi et al.

(10) Patent No.: US 10,571,837 B2
(45) Date of Patent: Feb. 25, 2020

(54) FIXING DEVICE AND IMAGE FORMING APPARATUS

(71) Applicants: Yoshiki Yamaguchi, Kanagawa (JP); Ippei Fujimoto, Kanagawa (JP); Hiroyuki Shimada, Tokyo (JP); Takayuki Seki, Kanagawa (JP); Takashi Seto, Kanagawa (JP); Yoshiyuki Fukuda, Tokyo (JP); Hiroshi Yoshinaga, Chiba (JP)

(72) Inventors: Yoshiki Yamaguchi, Kanagawa (JP); Ippei Fujimoto, Kanagawa (JP); Hiroyuki Shimada, Tokyo (JP); Takayuki Seki, Kanagawa (JP); Takashi Seto, Kanagawa (JP); Yoshiyuki Fukuda, Tokyo (JP); Hiroshi Yoshinaga, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/239,948

(22) Filed: Jan. 4, 2019

(65) Prior Publication Data

US 2019/0286025 A1 Sep. 19, 2019

(30) Foreign Application Priority Data

Mar. 15, 2018 (JP) ..... 2018-047715

(51) Int. Cl.
*G03G 15/20* (2006.01)

(52) U.S. Cl.
CPC ..... *G03G 15/2053* (2013.01); *G03G 15/206* (2013.01); *G03G 15/2064* (2013.01); *G03G 2215/2035* (2013.01)

(58) Field of Classification Search
CPC ..... G03G 15/2053; G03G 15/206; G03G 15/2064; G03G 2215/2035
See application file for complete search history.

(56) References Cited

U.S. PATENT DOCUMENTS

| | | | | |
|---|---|---|---|---|
| 2012/0237273 | A1* | 9/2012 | Yoshinaga ..... | G03G 15/2053 399/328 |
| 2013/0164058 | A1 | 6/2013 | Suzuki et al. | |
| 2013/0170877 | A1 | 7/2013 | Yoshiura et al. | |
| 2013/0170880 | A1 | 7/2013 | Gotoh et al. | |
| 2013/0195524 | A1 | 8/2013 | Ishii et al. | |
| 2016/0154350 | A1* | 6/2016 | Saito ..... | G03G 15/2057 399/329 |

(Continued)

FOREIGN PATENT DOCUMENTS

| | | |
|---|---|---|
| JP | 2007-041288 | 2/2007 |
| JP | 2013-137471 | 7/2013 |

(Continued)

*Primary Examiner* — Sophia S Chen
(74) *Attorney, Agent, or Firm* — Harness, Dickey & Pierce, P.L.C.

(57) ABSTRACT

A fixing device includes a fixing rotator that is flexible, endless, and rotatable. A heater heats the fixing rotator. A pressure rotator is disposed opposite the fixing rotator. A nip former defines a fixing nip between the fixing rotator and the pressure rotator. A support supports the nip former. The nip former includes a back face that contacts the support and has a nonlinear shape in a longitudinal direction of the nip former.

13 Claims, 5 Drawing Sheets

(56) References Cited

U.S. PATENT DOCUMENTS

| | | | | |
|---|---|---|---|---|
| 2017/0102656 | A1* | 4/2017 | Yamashita | G03G 15/206 |
| 2017/0176907 | A1 | 6/2017 | Sawada et al. | |
| 2017/0255147 | A1* | 9/2017 | Seki | G03G 15/2053 |
| 2017/0261900 | A1 | 9/2017 | Sawada et al. | |
| 2018/0284663 | A1* | 10/2018 | Matsuda | G03G 15/2053 |
| 2018/0335733 | A1 | 11/2018 | Matsuda et al. | |
| 2019/0235422 | A1* | 8/2019 | Yabuki | G03G 15/2064 |

FOREIGN PATENT DOCUMENTS

| | | |
|---|---|---|
| JP | 2013-152397 | 8/2013 |
| JP | 2017-125889 | 7/2017 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-047715, filed on Mar. 15, 2018, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing an image on a recording medium and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that includes a fixing belt and a heater (e.g., a halogen heater) disposed inside a loop formed by the fixing belt. A nip forming pad coated with a slide member is stationarily disposed inside the loop formed by the fixing belt. A stay supports the nip forming pad. A pressure roller is pressed against the nip forming pad to form a fixing nip. As a recording medium bearing a toner image is conveyed through the fixing nip, the fixing belt and the pressure roller fix the toner image on the recording medium under heat and pressure.

The stay may be bent by a load from the pressure roller, narrowing the fixing nip at a center of the fixing belt in an axial direction thereof. To address this circumstance, the nip forming pad or the stay may have a projection. However, since the slide member is a sheet, a fastener that secures the sheet to the nip forming pad may occupy a space inside the loop formed by the fixing belt, narrowing an irradiation range of the heater and restricting the shape of the projection.

SUMMARY

This specification describes below an improved fixing device. In one embodiment, the fixing device includes a fixing rotator that is flexible, endless, and rotatable. A heater heats the fixing rotator. A pressure rotator is disposed opposite the fixing rotator. A nip former defines a fixing nip between the fixing rotator and the pressure rotator. A support supports the nip former. The nip former includes a back face that contacts the support and has a nonlinear shape in a longitudinal direction of the nip former.

This specification further describes an improved fixing device. In one embodiment, the fixing device includes a fixing rotator that is flexible, endless, and rotatable. A heater heats the fixing rotator. A pressure rotator is disposed opposite the fixing rotator. A nip former defines a fixing nip between the fixing rotator and the pressure rotator. A support supports the nip former. The support includes a support face that supports the nip former and has a nonlinear shape in a longitudinal direction of the support.

This specification further describes an improved image forming apparatus. In one embodiment, the image forming apparatus includes an image bearer that bears an image and a fixing device that fixes the image on a recording medium. The fixing device includes a fixing rotator that is flexible, endless, and rotatable. A heater heats the fixing rotator. A pressure rotator is disposed opposite the fixing rotator. A nip former defines a fixing nip between the fixing rotator and the pressure rotator. A support supports the nip former. The nip former includes a back face that contacts the support and has a nonlinear shape in a longitudinal direction of the nip former.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
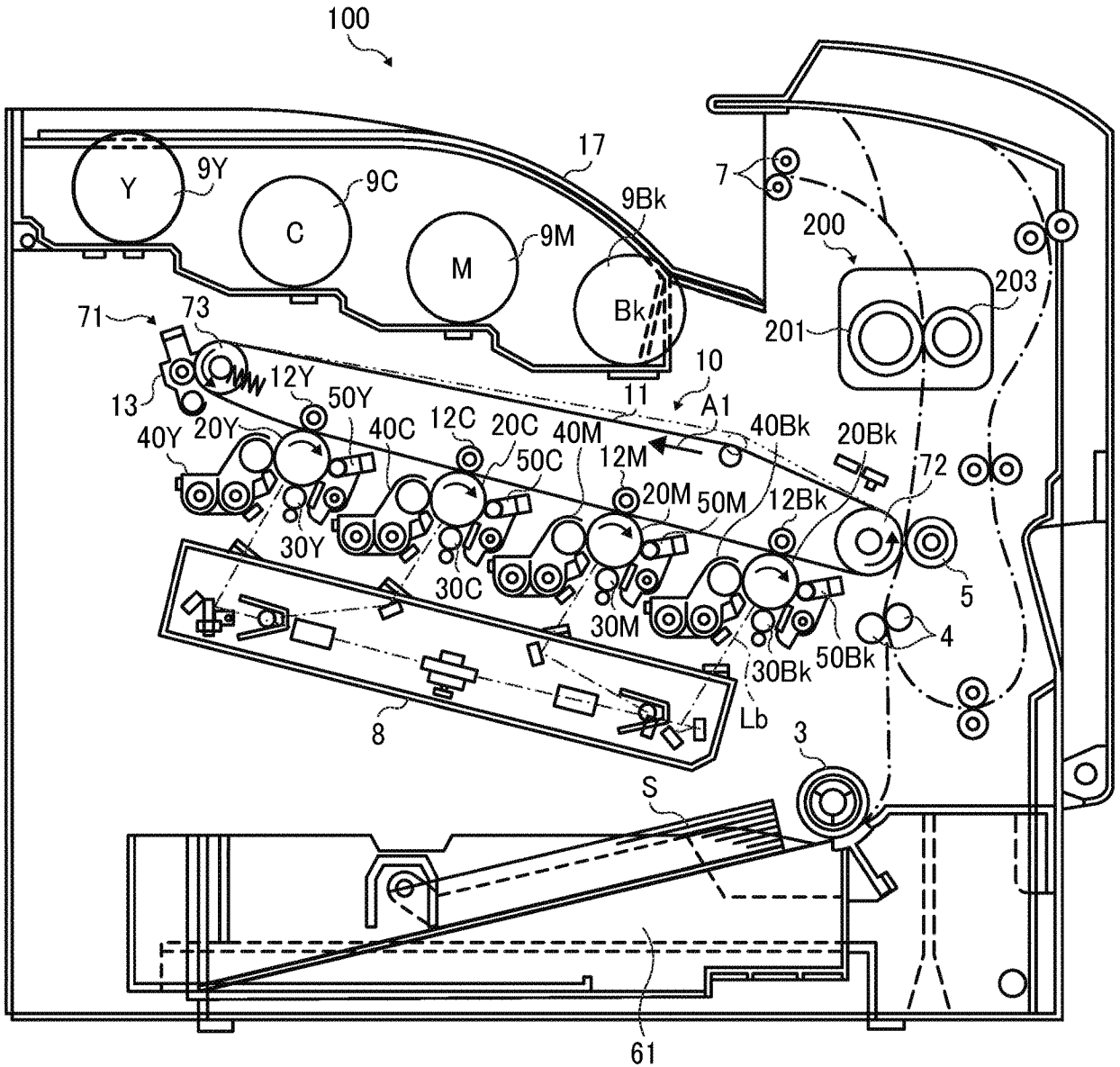
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 is explained.

The image forming apparatus 100 may be a copier, a facsimile machine, a printer, a multifunction peripheral or a multifunction printer (MFP) having at least two of copying, printing, scanning, facsimile, plotter, and other functions, or the like. According to this embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

Referring to FIG. 1, a description is provided of a construction of the image forming apparatus 100 installed with a fixing device 200 according to an embodiment.

The image forming apparatus 100 illustrated in FIG. 1 is a color printer employing a tandem system in which a plurality of image forming devices that forms images in a plurality of colors is aligned in a stretch direction of a transfer belt 11. Alternatively, the fixing device 200 according to this embodiment may be installed in image forming apparatuses employing systems other than the tandem system. According to this embodiment, the image forming apparatus 100 is a printer. Alternatively, the image forming apparatus 100 may be a copier, a facsimile machine, or the like.

The image forming apparatus 100 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100 having the construction illustrated in FIG. 1, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt that moves in a direction A1 while the transfer belt 11 is disposed opposite the photoconductive drums 20Y, 20C, 20M, and 20Bk. Thereafter, the visible images formed on the transfer belt 11 are transferred collectively onto a recording medium S (e.g., a recording sheet) in a secondary transfer process.

Each of the photoconductive drums 20Y, 20C, 20M, and 20Bk is surrounded by the image forming devices that form the visible images as the photoconductive drums 20Y, 20C, 20M, and 20Bk rotate. Taking the photoconductive drum 20Bk that forms a black toner image as an example, a charger 30Bk, a developing device 40Bk, a primary transfer roller 12Bk, and a cleaner 50Bk which form the black toner image are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 8 is used for writing after charging the photoconductive drum 20Bk.

While the transfer belt 11 rotates in the direction A1, the visible images formed on the photoconductive drums 20Y, 20C, 20M, and 20Bk are transferred onto the transfer belt 11 such that the visible images are superimposed on a same position on the transfer belt 11. The primary transfer rollers 12Y, 12C, 12M, and 12Bk disposed opposite the photoconductive drums 20Y, 20C, 20M, and 20Bk via the transfer belt 11 apply voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from upstream to downstream in the direction A1. Imaging stations that form yellow, cyan, magenta, and black toner images accommodate the photoconductive drums 20Y, 20C, 20M, and 20Bk, respectively.

The image forming apparatus 100 further includes four imaging stations, a transfer belt unit 10, a secondary transfer roller 5, a cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 serves as a transferor or a transfer roller that is disposed opposite the transfer belt 11 and rotates in accordance with rotation of the transfer belt 11. The cleaner 13 is disposed opposite the transfer belt 11 and cleans a surface of the transfer belt 11. The optical writing device 8 serves as an optical writer disposed opposite and below the four imaging stations.

The optical writing device 8 includes a semiconductor laser serving as a light source, a coupling lens, an f-θ lens, a toroidal lens, a reflecting mirror, and a polygon mirror serving as a deflector. The optical writing device 8 emits laser beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the laser beam Lb directed to the imaging station that forms the black toner image, the laser beams Lb are also directed to the imaging stations that form yellow, cyan, and magenta toner images, respectively.

The image forming apparatus 100 further includes a sheet feeder 61, a registration roller pair 4, and a sensor. The sheet feeder 61 is a sheet feeding tray (e.g., a paper tray) that loads recording media S to be conveyed to a secondary transfer nip formed between the secondary transfer roller 5 and the transfer belt 11. The registration roller pair 4 feeds the recording medium S conveyed from the sheet feeder 61 to the secondary transfer nip at a predetermined time when the yellow, cyan, magenta, and black toner images formed on the transfer belt 11 by the imaging stations reach the secondary transfer nip. The sensor detects that a leading edge of the recording medium S reaches the registration roller pair 4.

The image forming apparatus 100 further includes the fixing device 200, a sheet ejection roller pair 7, a sheet ejection tray 17, and toner bottles 9Y, 9C, 9M, and 9Bk. The fixing device 200 fixes a color toner image transferred onto a recording medium S thereon in a roller fixing method. The color toner image is formed by transferring the yellow, cyan, magenta, and black toner images formed on the transfer belt 11 onto the recording medium S. The sheet ejection roller pair 7 ejects the recording medium S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording media S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. Hence, the driven roller 73 includes a biasing member such as a spring. The transfer belt unit 10, the primary transfer rollers 12Y, 12C, 12M, and 12Bk, the secondary transfer roller 5, and the cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording medium S. As the sheet feeding roller 3 is driven and rotated counterclockwise in FIG. 1, the sheet feeding roller 3 feeds the uppermost recording medium S to the registration roller pair 4.

The cleaner 13 installed in the transfer device 71, although the cleaner 13 is schematically illustrated in FIG. 1, includes a cleaning brush and a cleaning blade that are disposed opposite and come into contact with the transfer belt 11. The cleaning brush and the cleaning blade scrape and remove a foreign substance such as residual toner from the transfer belt 11, cleaning the transfer belt 11.

The cleaner 13 further includes a discharging device that conveys the residual toner removed from the transfer belt 11 for disposal.

A description is provided of a construction of the fixing device 200 according to a first embodiment that is incorporated in the image forming apparatus 100.

Figure 2:
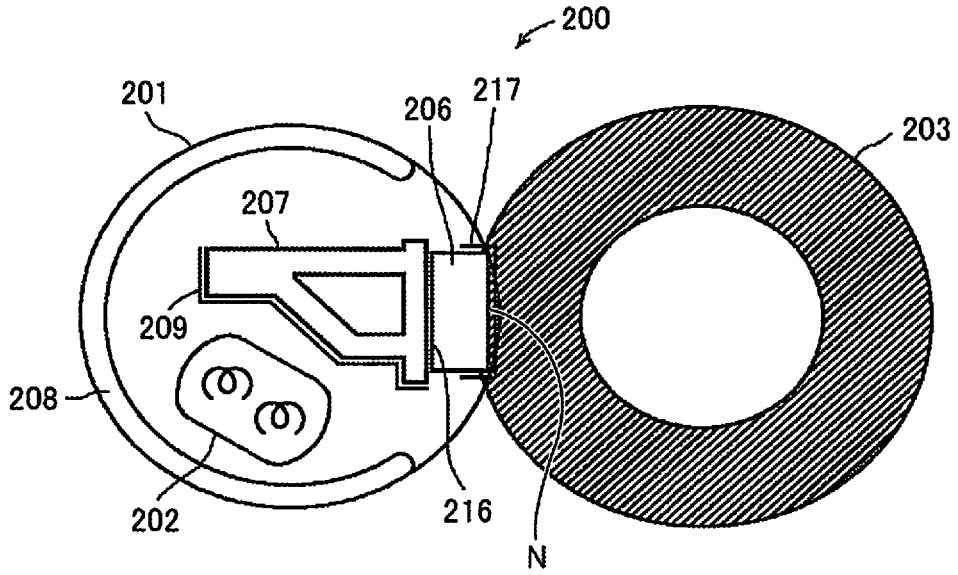
FIG. 2 is a schematic cross-sectional view of a fixing device according to a first embodiment of the present disclosure, which is incorporated in the image forming apparatus depicted in FIG. 1.

FIG. 2 is a schematic cross-sectional view of the fixing device 200 according to the first embodiment.

The fixing device 200 includes a pressure roller 203 and a fixing belt 201 disposed opposite the pressure roller 203. The pressure roller 203 serves as a pressure rotator or a pressure member. The fixing belt 201 serves as a fixing rotator or a fixing member, that is, an endless belt which is flexible and rotatable. The fixing device 200 further includes a nip forming pad 206, a stay 207, a halogen heater 202, a reflector 209, and a flange 208, which are disposed inside a loop formed by the fixing belt 201. The pressure roller 203 is pressed against the nip forming pad 206, serving as a nip former, via the fixing belt 201 to form a fixing nip N between the fixing belt 201 and the pressure roller 203. The stay 207 serves as a support that supports the nip forming pad 206. The halogen heater 202 serves as a heater that heats the fixing belt 201 that rotates while sliding over an outer surface of the nip forming pad 206. The reflector 209 reflects radiant heat from the halogen heater 202. The flange 208 serves as a holder that holds those elements (e.g., the fixing belt 201, the halogen heater 202, the nip forming pad 206, the stay 207, and the reflector 209).

A detailed description is now given of a construction of the nip forming pad 206.

As illustrated in FIG. 2, the nip forming pad 206 is an assembly constructed of a plurality of resin parts and metal parts. A thermal equalizer 217 is disposed on a nip face of the nip forming pad 206, which is disposed opposite the pressure roller 203, to equalize the temperature of the fixing belt 201 in an axial direction thereof. The thermal equalizer 217 includes a thermal absorber at a part of the thermal equalizer 217. The thermal absorber absorbs heat radiated from the halogen heater 202. The thermal equalizer 217 conducts heat received by the thermal absorber to the fixing nip N. The thermal absorber is treated with black coating to absorb heat from the halogen heater 202 effectively. In order to conduct heat quickly and even a temperature distribution, the thermal equalizer 217 is preferably made of a material having an increased thermal conductivity such as gold, silver, copper, and graphite.

According to this embodiment, the thermal equalizer 217 is made of native copper in view of manufacturing costs, processability, and strength. Since the thermal equalizer 217 is disposed in proximity to the fixing nip N, in view of thermal capacity and thermal equalization, the thermal equalizer 217 is preferably a sheet metal being made of native copper and having a thickness in a range of from about 0.4 mm to about 1.0 mm. Thus, an inner circumferential surface of the fixing belt 201 slides over the nip forming pad 206 indirectly via the thermal equalizer 217.

A detailed description is now given of a construction of the pressure roller 203.

The pressure roller 203 includes a metal roller, a silicone rubber layer, and a release layer. The silicone rubber layer coats the metal roller. The release layer serves as a surface layer that facilitates separation of the recording medium S from the pressure roller 203. The release layer is made of tetrafluoroethylene-perfluoroalkylvinylether copolymer (PFA), polytetrafluoroethylene (PTFE), or the like. A driving force is transmitted to the pressure roller 203 from a driver such as a motor disposed in the image forming apparatus 100 through a gear, thus rotating the pressure roller 203.

A spring or the like presses the pressure roller 203 against the fixing belt 201. As the spring presses and deforms the silicone rubber layer of the pressure roller 203, the pressure roller 203 forms the fixing nip N having a predetermined length in a recording medium conveyance direction.

The pressure roller 203 may be a solid roller or a hollow roller. However, the hollow roller preferably has a decreased thermal capacity. Alternatively, a heater such as a halogen heater may be disposed inside the pressure roller 203. The silicone rubber layer may be made of solid rubber. Alternatively, if no heater is disposed inside the pressure roller 203, sponge rubber may be used. The sponge rubber preferably enhances thermal insulation of the pressure roller 203, causing the pressure roller 203 to draw less heat from the fixing belt 201.

A detailed description is now given of a construction of the fixing belt 201.

The fixing belt 201 is an endless belt or film made of metal such as nickel and SUS stainless steel or resin such as polyimide. The fixing belt 201 includes a base layer and a release layer. The release layer serves as a surface layer made of PFA, PTFE, or the like, facilitating separation of the recording medium S from the fixing belt 201 and preventing toner from adhering to the fixing belt 201.

Optionally, an elastic layer made of silicone rubber or the like may be interposed between the base layer and the release layer. If the fixing belt 201 does not incorporate the elastic layer, the fixing belt 201 attains a decreased thermal capacity that improves fixing property of being heated quickly. However, when the pressure roller 203 presses and deforms an unfixed toner image to fix the toner image on the recording medium S, slight surface asperities of the fixing belt 201 may be transferred onto the toner image, causing a disadvantage that an orange peel mark remains on a solid part of the toner image. To address this circumstance, the elastic layer has a thickness of 100 micrometers or more. As the elastic layer deforms, the elastic layer absorbs the slight surface asperities, preventing the orange peel mark on the toner image.

A detailed description is now given of a configuration of the stay 207.

The stay 207 is disposed inside the loop formed by the fixing belt 201 and serves as a support that supports the nip forming pad 206. The stay 207 prevents the nip forming pad 206 from being bent by pressure from the pressure roller 203, attaining a uniform length of the fixing nip N in the recording medium conveyance direction throughout the entire width of the fixing belt 201 in the axial direction thereof, that is, a direction perpendicular to a surface of paper illustrated with FIG. 2. In order to attain rigidity, the stay 207 is made of metal such as aluminum, iron, and stainless steel. Both ends of the stay 207 in the axial direction of the fixing belt 201 are supported by and secured to side plates of the fixing device 200, respectively, thus being positioned inside the loop formed by the fixing belt 201.

The resin part of the nip forming pad 206 is preferably produced by injection molding with heat resistant resin. The heat resistant resin is preferably liquid crystal polymer (LCP) having a heat resistant temperature of about 330 degrees centigrade, polyetherketone (PEK) having a heat resistant temperature of about 350 degrees centigrade, or the like.

A detailed description is now given of a configuration of the reflector 209.

The reflector 209 is interposed between the halogen heater 202 and the stay 207. The reflector 209 reflects radiant heat and the like from the halogen heater 202, suppressing heating of the stay 207 with radiant heat and the like and resultant waste of energy. Instead of the reflector 209, a surface of the stay 207 may be treated with insulation or mirror finish to attain similar advantages.

According to this embodiment, the halogen heater 202 is used as a heater. Alternatively, an induction heating (IH) coil, a resistive heat generator, a carbon heater, or the like may be used as a heater.

The fixing belt 201 rotates in accordance with rotation of an exterior roller. As the driver drives and rotates the pressure roller 203, the driving force of the pressure roller 203 is transmitted to the fixing belt 201 at the fixing nip N, rotating the fixing belt 201 in accordance with rotation of the pressure roller 203.

The fixing device 200 according to this embodiment may further include a shield interposed between the halogen heater 202 and the fixing belt 201 to shield the fixing belt 201 from heat from the halogen heater 202. Since the shield is requested to have a substantially increased heat resistance, the shield is preferably made of aluminum, iron, stainless steel, or the like.

The shield is manufactured by shaping a metal plate having a thickness in a range of from 0.1 mm to 1.0 mm into a circular arc in cross-section along the inner circumferential surface of the fixing belt 201. The shield moves in a circumferential direction of the fixing belt 201 as needed.

With the construction described above, the fixing device 200 attaining quick warmup is manufactured at reduced costs.

Figure 3:
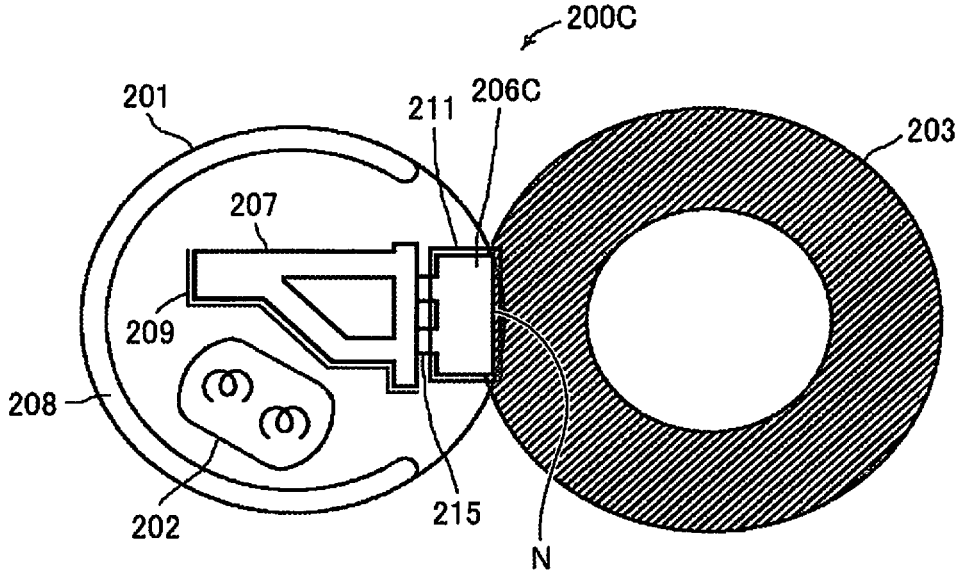
FIG. 3 Background Art
FIG. 3 is a schematic cross-sectional view of a fixing device as a comparative example.
Figure 4:
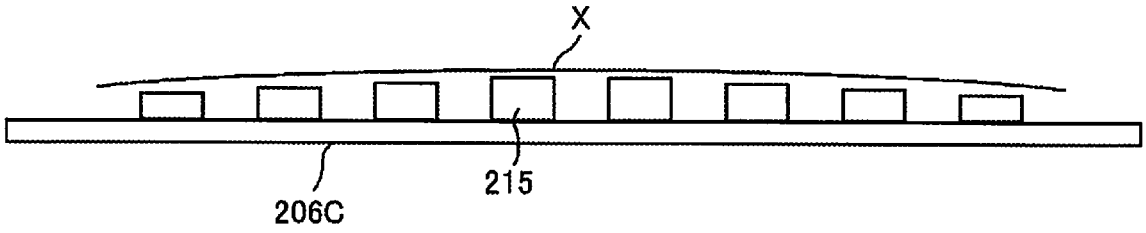
Background Art FIG. 4
FIG. 4 is a schematic cross-sectional view of a nip forming pad seen in a recording medium conveyance direction, which is incorporated in the fixing device depicted in FIG. 3.

Referring to FIGS. 3 and 4, a description is provided of a construction of a fixing device 200C as a comparative example.

FIG. 3 is a schematic cross-sectional view of the fixing device 200C. FIG. 4 is a schematic cross-sectional view of a nip forming pad 206C of the fixing device 200C seen in the recording medium conveyance direction.

As illustrated in FIG. 3, the fixing device 200C includes a slide sheet 211. In order to reduce a frictional slide resistance at the fixing nip N, the slide sheet 211 produced with yarn made of PTFE and impregnated with a lubricant such as silicone oil is secured to the nip forming pad 206C made of resin. One role of the nip forming pad 206C configured as described above is to hold the slide sheet 211. The slide sheet 211 is wound around the nip forming pad 206C and fastened to a back face of the nip forming pad 206C with a screw. The back face of the nip forming pad 206C is opposite a nip face thereof that faces the fixing nip N. As the screw strikes the stay 207, the screw may degrade precision in positioning the nip forming pad 206C that forms the fixing nip N. To address this circumstance, a plurality of projections 215 is mounted on the back face of the nip forming pad 206C, preventing screw heads from contacting the stay 207 and thereby causing the projections 215 to contact the stay 207.

As illustrated in FIG. 4 with a hypothetical ridge X defined by summits of the projections 215, a ridge that bridges the summits of the projections 215 draws a gentle curve. For example, the ridge has a convex shape defined by one lateral end, a center, and another lateral end of the nip forming pad 206C in a longitudinal direction thereof. In other words, the height of the projections 215 is small at both lateral ends of the nip forming pad 206C and is great at the center of the nip forming pad 206C. Accordingly, the projections 215 cancel or offset bending of the stay 207, that is, a depression at a center of the stay 207 in a longitudinal direction thereof, when the stay 207 receives pressure from the pressure roller 203, thus producing the planar fixing nip N. FIG. 4 illustrates the nip forming pad 206C from one lateral end to another lateral end of the nip forming pad 206C in the longitudinal direction thereof.

However, since the height of the projections 215 is ensured to prevent the screw heads from contacting the stay 207, the projections 215 inhibit the stay 207 from being situated closer to the pressure roller 203 by the height of the projections 215, thus narrowing an irradiation range of the halogen heater 202. Additionally, the nip forming pad 206C having the convex shape is difficult to process because of high precision in processing.

The slide sheet 211 made of a low friction material and impregnated with a lubricant is interposed between the nip forming pad 206C and the fixing belt 201 at the fixing nip N throughout the entire width of the nip forming pad 206C in the longitudinal direction thereof. The slide sheet 211 covers the nip forming pad 206C in a circumferential direction thereof. The slide sheet 211 is secured to the nip forming pad 206C with the screw in addition to an adhesive.

However, the projections 215 are mounted on the nip forming pad 206C to prevent the screw from contacting the stay 207. The projections 215 occupy a space inside the loop formed by the fixing belt 201. Thus, the projections 215 may narrow the irradiation range of the halogen heater 202, degrading heating efficiency.

Additionally, the fixing nip N is requested to have a uniform length in the recording medium conveyance direction throughout the entire width of the fixing belt 201 in the axial direction thereof.

To address the above-described circumstances, the fixing device 200 according to the first embodiment depicted in FIG. 2 includes the nip forming pad 206 that does not have projections. The nip forming pad 206 is planar and is made of resin.

Figure 5:
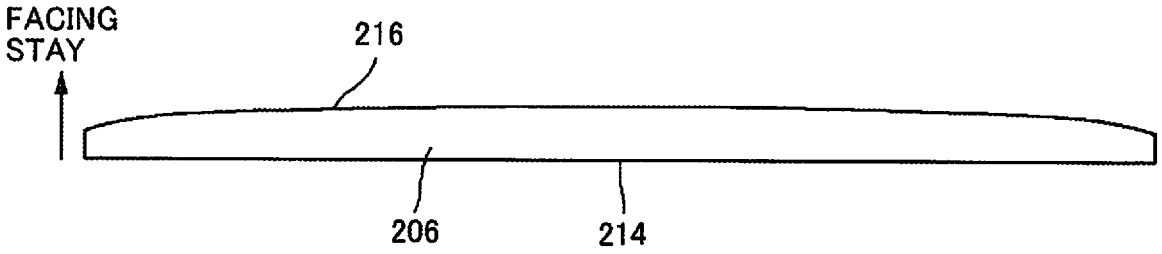
FIG. 5 is a schematic cross-sectional view of a nip forming pad seen in the recording medium conveyance direction, which is incorporated in the fixing device depicted in FIG. 2.

FIG. 5 is a schematic cross-sectional view of the nip forming pad 206. As illustrated in FIG. 5, the nip forming pad 206 includes a back face 216 that contacts the stay 207 and has a nonlinear shape in a longitudinal direction of the nip forming pad 206. The nonlinear shape defines a shape created by a plurality of shape changing points within a maximum conveyance span in which a recording medium S of a maximum size is conveyed through the fixing device 200.

Figure 6A:
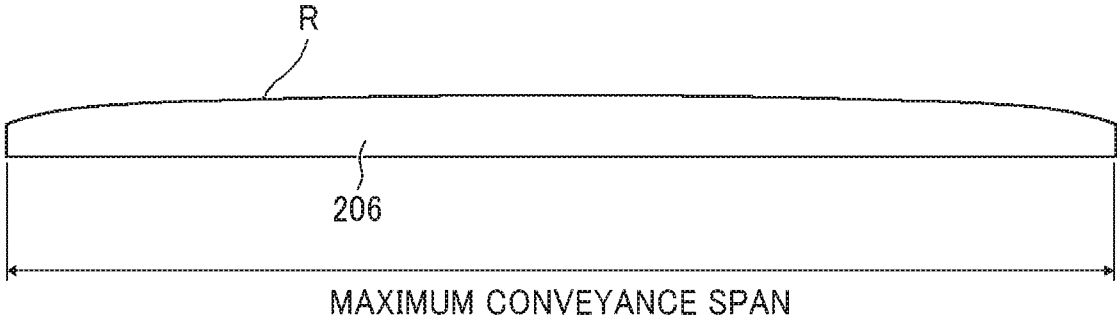
FIG. 6A is a schematic cross-sectional view of the nip forming pad depicted in FIG. 5, illustrating a nonlinear shape thereof.

For example, the nonlinear shape includes a round shape illustrated in FIG. 6A and other curved shapes. The nonlinear shape further includes a mountain shape and an inverted V-shape illustrated in FIG. 6B. The round shape illustrated in FIG. 6A and other curved shapes define an aggregation of continuous shape changing points. The mountain shape and the inverted V-shape illustrated in FIG. 6B define a convex shape created with a straight line extending from one lateral end to a center of the nip forming pad 206 and a straight line extending from the center to another lateral end of the nip forming pad 206 in the longitudinal direction thereof. The convex shape has a shape changing point Y at the center of the nip forming pad 206 in the longitudinal direction thereof.

Figure 6B:
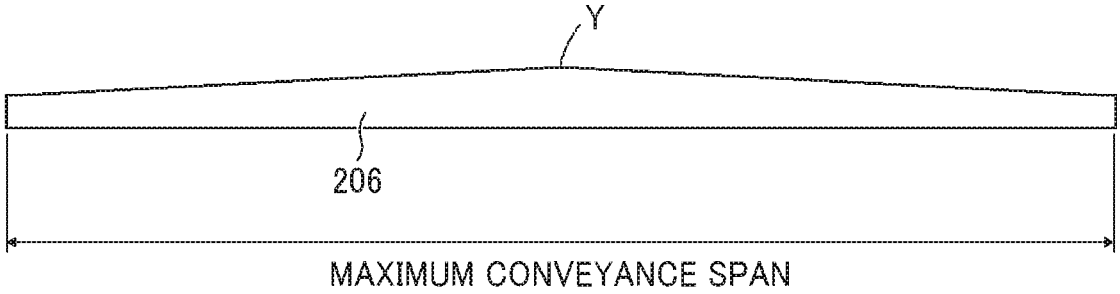
FIG. 6B is a schematic cross-sectional view of the nip forming pad depicted in FIG. 5, illustrating another nonlinear shape thereof.

FIG. 6A is a schematic cross-sectional view of the nip forming pad 206 seen in the recording medium conveyance direction, illustrating the round shape of the nip forming pad 206. FIG. 6B is a schematic cross-sectional view of the nip forming pad 206 seen in the recording medium conveyance direction, illustrating the convex shape of the nip forming pad 206.

Specifically, as illustrated in FIG. 5, when seen in the recording medium conveyance direction, the center of the nip forming pad 206 in the longitudinal direction thereof projects toward the stay 207. A front face 214 of the nip forming pad 206, which is disposed opposite the pressure roller 203, is planar. In other words, the back face 216 of the nip forming pad 206 has the convex shape, for example, the round shape. The front face 214 of the nip forming pad 206, that is, the nip face that forms the fixing nip N, has a planar shape. Hence, the nonlinear shape of the nip forming pad 206 includes the convex shape with respect to the stay 207. Accordingly, the nip forming pad 206 having the simple structure cancels or offsets bending of the stay 207, that is, the depression at the center of the stay 207 in the longitudinal direction thereof, when the stay 207 receives pressure from the pressure roller 203, thus producing the fixing nip N having the uniform length in the recording medium conveyance direction throughout the entire width of the fixing belt 201 in the axial direction thereof.

The nip forming pad 206 projects toward the stay 207 because it is effective for the back face 216 of the nip forming pad 206, which faces and contacts the stay 207, to have the convex shape to cancel or offset the depression of the stay 207 at the center of the stay 207 in the longitudinal direction thereof.

Additionally, as illustrated in FIG. 6A, the back face 216 of the nip forming pad 206 includes a round portion R that is not interrupted and is continuous. An entirety of the round portion R of the back face 216 of the nip forming pad 206 contacts the stay 207. Thus, the nip forming pad 206 forms the fixing nip N that attains the uniform length in the recording medium conveyance direction and uniform pressure throughout the entire width of the fixing belt 201 in the axial direction thereof.

Unlike the nip forming pad 206C as the comparative example depicted in FIGS. 3 and 4, the nip forming pad 206 depicted in FIGS. 2 and 5 does not mount the projections 215, the slide sheet 211, and the screw that secures the slide sheet 211 to the nip forming pad 206C. Hence, the stay 207 contacts an entirety of the back face 216 of the nip forming pad 206. Accordingly, compared to the fixing device 200C as the comparative example depicted in FIG. 3, the fixing device 200 according to the first embodiment depicted in FIG. 2 allows the stay 207 to be situated closer to the pressure roller 203, increasing the irradiation range of the halogen heater 202 by a distance of displacement of the stay 207. Consequently, a warmup time of the fixing belt 201 is shortened, saving energy. The nip forming pad 206 does not mount the projections 215, facilitating processing of the nip forming pad 206.

As illustrated in FIG. 2, the fixing device 200 according to the first embodiment includes the thermal equalizer 217, instead of the slide sheet 211, interposed between the nip forming pad 206 and the fixing belt 201. The thermal equalizer 217 equalizes the temperature of the fixing belt 201 in the axial direction thereof. The thermal equalizer 217 is linear in a longitudinal direction thereof. A surface of the thermal equalizer 217, which contacts the fixing belt 201, is coated with fluororesin as a slide facilitating material that facilitates sliding of the fixing belt 201 over the thermal equalizer 217. Thus, the thermal equalizer 217 decreases friction between the fixing belt 201 and the thermal equalizer 217, reducing abrasion of the inner circumferential surface of the fixing belt 201. The fixing device 200 is installed with the thermal equalizer 217 coated with fluororesin, instead of the slide sheet 211, eliminating the projections 215 depicted in FIG. 3 and the screw and therefore saving space. Accordingly, the stay 207 is situated closer to the pressure roller 203, increasing the irradiation range of the halogen heater 202.

According to this embodiment, the front face 214 of the nip forming pad 206 mounts the thermal equalizer 217 coated with the slide facilitating material. Alternatively, instead of the thermal equalizer 217, the front face 214 of the nip forming pad 206 may be coated with the slide facilitating material directly. Accordingly, although the front face 214 coated with the slide facilitating material equalizes heat less than the thermal equalizer 217, the front face 214 improves sliding of the fixing belt 201 and reduces manufacturing costs by eliminating the thermal equalizer 217.

Another role of the nip forming pad 206 made of resin is insulation. As illustrated in FIG. 3, if the slide sheet 211 coats the nip forming pad 206C directly to form the fixing nip N, the nip forming pad 206C absorbs heat from the fixing belt 201, increasing the warmup time of the fixing belt 201 and a Typical Electricity Consumption (TEC) value. However, although the nip forming pad 206 improves insulation, the nip forming pad 206 may cause the fixing belt 201 to be susceptible to temperature increase at both lateral ends of the fixing belt 201 in the axial direction thereof after a plurality of recording media S is conveyed through the fixing device 200 continuously.

To address this circumstance, as illustrated in FIG. 2, the thermal equalizer 217 made of copper or the like that has an increased thermal conductivity preferably coats the nip forming pad 206. In order to improve insulation, the fixing device 200 according to this embodiment employs the thermal equalizer 217 treated with coating that facilitates sliding of the fixing belt 201, improving heating efficiency and reducing manufacturing costs compared to the fixing device 200C as the comparative example. Since the thermal equalizer 217 treated with coating serves as a slide member that facilitates sliding of the fixing belt 201, unlike the slide sheet 211, the thermal equalizer 217 is not fastened to a separate element with a screw.

A description is provided of a construction of a fixing device 200S according to a second embodiment of the present disclosure that is incorporated in the image forming apparatus 100.

Figure 7:
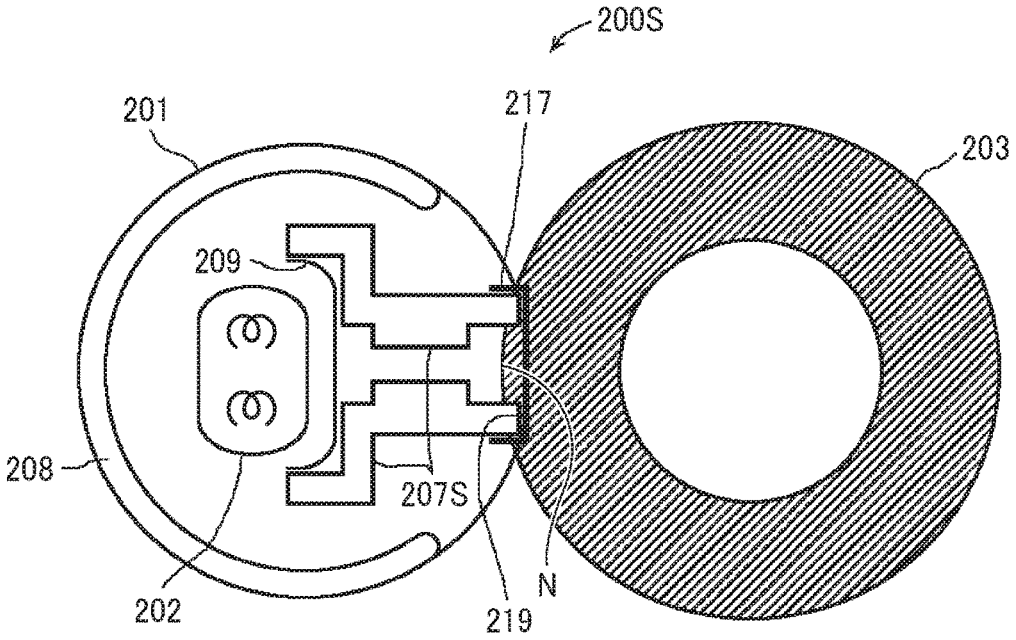
FIG. 7 is a schematic cross-sectional view of a fixing device according to a second embodiment of the present disclosure.

FIG. 7 is a schematic cross-sectional view of the fixing device 200S according to the second embodiment.

The fixing device 200S includes the pressure roller 203 and the fixing belt 201 disposed opposite the pressure roller 203. The pressure roller 203 serves as a pressure rotator or a pressure member. The fixing belt 201 serves as a fixing rotator or a fixing member, that is, an endless belt which is flexible and rotatable. The fixing device 200S further includes the thermal equalizer 217, a stay 207S, the halogen heater 202, the reflector 209, and the flange 208, which are disposed inside the loop formed by the fixing belt 201. The pressure roller 203 is pressed against the thermal equalizer 217, serving as a nip former, via the fixing belt 201 to form the fixing nip N between the fixing belt 201 and the pressure roller 203. The stay 207S serves as a support that supports the thermal equalizer 217 directly or indirectly via other element. The halogen heater 202 serves as a heater that heats the fixing belt 201 that rotates while sliding over an outer surface of the thermal equalizer 217. The reflector 209 reflects radiant heat from the halogen heater 202. The flange 208 serves as a holder that holds those elements (e.g., the fixing belt 201, the halogen heater 202, the thermal equalizer 217, the stay 207S, and the reflector 209).

According to this embodiment, the stay 207S supports the thermal equalizer 217 that receives load from the pressure roller 203. The stay 207S includes a support face 219 that supports the thermal equalizer 217 and has a nonlinear shape in a longitudinal direction of the stay 207S. For example, the stay 207S includes two portions, that is, an upstream portion and a downstream portion disposed downstream from the upstream portion in the recording medium conveyance direction. The upstream portion and the downstream portion are symmetrical in shape. The support face 219 of each of the upstream portion and the downstream portion has the nonlinear shape in the longitudinal direction of the stay 207S.

Figure 8:
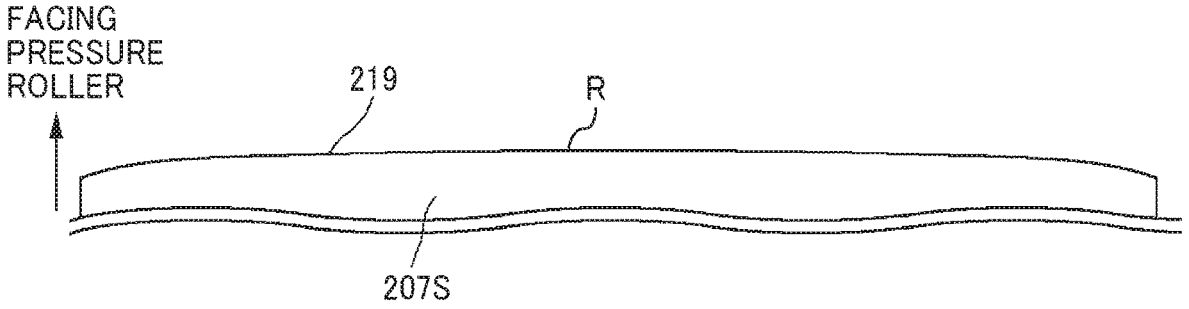
FIG. 8 is a schematic cross-sectional view of a stay seen in the recording medium conveyance direction, illustrating a support face thereof.

FIG. 8 is a schematic cross-sectional view of the stay 207S seen in the recording medium conveyance direction, illustrating the support face 219. As illustrated in FIG. 8, when seen in the recording medium conveyance direction, a center of the stay 207S in the longitudinal direction thereof projects toward the pressure roller 203. Hence, the nonlinear shape of the support face 219 of the stay 207S includes the convex shape with respect to the pressure roller 203. Accordingly, the support face 219 cancels or offsets bending of the stay 207S, that is, a depression at the center of the stay 207S in the longitudinal direction thereof, when the stay 207S receives pressure from the pressure roller 203, thus producing the planar fixing nip N.

A direction of projection of the support face 219 of the stay 207S of the fixing device 200S according to the second embodiment is different from a direction of projection of the back face 216 of the nip forming pad 206 of the fixing device 200 according to the first embodiment depicted in FIGS. 2 and 5 due to a reason below. It is difficult to contour the thermal equalizer 217 made of metal into a smooth convex shape to cancel or offset the depression at the center of the stay 207S in the longitudinal direction thereof. Hence, the support face 219 of the stay 207S, which faces the pressure roller 203, has the convex shape.

Additionally, the support face 219 of the stay 207S includes a round portion R that is not interrupted and is continuous. An entirety of the round portion R of the support face 219 contacts the thermal equalizer 217 or other element. Thus, the stay 207S forms the fixing nip N that has the uniform length in the recording medium conveyance direction and uniform pressure throughout the entire width of the fixing belt 201 in the axial direction thereof.

The support face 219 is a cut section of the stay 207S produced by processing. A round shape, that is, the round portion R, of the support face 219 is created readily by cutting while the stay 207S is processed. Since the cut section of the stay 207S supports the thermal equalizer 217, the thermal equalizer 217 contacts the stay 207S linearly, decreasing conduction of heat generated by the halogen heater 202 from the thermal equalizer 217 to the stay 207S.

A thermal insulation sheet made of a heat insulating material such as resin is preferably used as other element interposed between the stay 207S and the thermal equalizer 217.

Unlike the fixing device 200C as the comparative example depicted in FIGS. 3 and 4, the fixing device 200S depicted in FIGS. 7 and 8 does not incorporate the nip forming pad 206C made of resin, the slide sheet 211, and the screw that secures the slide sheet 211 to the nip forming pad 206C. Accordingly, compared to the fixing device 200C as the comparative example depicted in FIG. 3, the fixing device 200S according to the second embodiment depicted in FIG. 7 allows the stay 207S to be situated closer to the pressure roller 203, increasing the irradiation range of the halogen heater 202 by a distance of displacement of the stay 207S. Consequently, the warmup time of the fixing belt 201 is shortened, saving energy.

The fixing device 200 according to the first embodiment depicted in FIGS. 2 and 5 incorporates the nip forming pad 206 having the convex shape. Conversely, the fixing device 200S according to the second embodiment depicted in FIGS. 7 and 8 eliminates the nip forming pad 206 and renders the support face 219, that is, the cut section, of the stay 207S to have the convex shape. Accordingly, the depression that appears at the center of the stay 207S in the longitudinal direction thereof when the stay 207S receives load from the pressure roller 203 cancels or offsets a projection, that is, the convex shape, of the stay 207S, thus planarizing the stay 207S. Consequently, the fixing device 200S causes the stay 207S to support the thermal equalizer 217 directly, without installing the nip forming pad 206 made of resin, preventing the length of the fixing nip N from decreasing at the center of the fixing belt 201 in the axial direction thereof.

As described above, the thermal equalizer 217 and the stay 207S of the fixing device 200S according to the second embodiment functionally replace the nip forming pad 206C, made of resin, of the fixing device 200C as the comparative example. The nip forming pad 206C made of resin needs a clearance defined by the projections 215 to prevent the screw head for securing the slide sheet 211 to the nip forming pad 206C from contacting the stay 207, occupying a space in a layout inside the loop formed by the fixing belt 201. To address this circumstance, elimination of the nip forming pad 206C made of resin spares an extra space that allows the stay 207S to be situated closer to the fixing nip N, increasing the irradiation range of the halogen heater 202 and therefore improving efficiency in heating the fixing belt 201. Accordingly, the warmup time is shortened and the Typical Electricity Consumption (TEC) value is improved.

The thermal equalizer 217 serving as a nip former is treated with direct coating, eliminating a securing space occupied to secure the slide sheet 211 to the nip forming pad 206C. The stay 207S is moved to the securing space to increase an irradiation angle of the halogen heater 202, improving heating efficiency. Accordingly, the number of parts installed in the fixing device 200S is decreased, reducing manufacturing costs and the thermal capacity of the fixing device 200S.

Since the plurality of projections 215, that is scattered, of the fixing device 200C as the comparative example defines the convex shape, unless the nip forming pad 206C has a certain rigidity, spotted depressurization may occur between the adjacent projections 215. Additionally, since the plurality of projections 215 that is scattered produces the ridge defining the convex shape, it is difficult to process the nip forming pad 206C. Conversely, the fixing device 200S according to the second embodiment depicted in FIGS. 7 and 8 causes the cut section of the stay 207S to have the continuous convex shape. Accordingly, the stay 207S is processed readily without the spotted depressurization between the adjacent projections 215.

The image forming apparatus 100 incorporates the fixing device 200 or 200S that attains the uniform length of the fixing nip N in the recording medium conveyance direction throughout the entire width of the fixing belt 201 in the axial direction thereof with reduced manufacturing costs and decreased thermal capacity.

A description is provided of advantages of a fixing device (e.g., the fixing devices 200 and 200S).

As illustrated in FIGS. 2 and 7, the fixing device includes a fixing rotator (e.g., the fixing belt 201), a heater (e.g., the halogen heater 202), a pressure rotator (e.g., the pressure roller 203), a nip former (e.g., the nip forming pad 206 and the thermal equalizer 217), and a support (e.g., the stays 207 and 207S).

The fixing rotator is endless, flexible, and rotatable. The heater heats the fixing rotator. The pressure rotator is disposed opposite the fixing rotator. The pressure rotator is pressed against the nip former via the fixing rotator so that the nip former defines a fixing nip (e.g., the fixing nip N) between the fixing rotator and the pressure rotator. The support supports the nip former. As illustrated in FIG. 5, the nip former includes a back face (e.g., the back face 216) that contacts the support. The back face has a nonlinear shape in a longitudinal direction of the nip former.

The fixing device increases an irradiation range of the heater, shortening a warmup time and saving energy. Additionally, the nip former having a simple structure cancels or offsets bending of the support, producing the fixing nip having a uniform length in a recording medium conveyance direction throughout an entire width of the fixing rotator in an axial direction thereof.

According to the embodiments described above, the fixing belt 201 serves as a fixing rotator. Alternatively, a fixing film, a fixing sleeve, or the like may be used as a fixing rotator. Further, the pressure roller 203 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing rotator that is flexible, endless, and rotatable;

a heater to heat the fixing rotator;

a pressure rotator disposed opposite the fixing rotator;

a nip former to define a fixing nip between the fixing rotator and the pressure rotator;

a support supporting the nip former, the nip former including a back face that contacts the support and has a nonlinear shape in a longitudinal direction of the nip former; and a thermal equalizer interposed between the nip former and the fixing rotator, the thermal equalizer to equalize a temperature of the fixing rotator in an axial direction of the fixing rotator, wherein a surface of the thermal equalizer, which contacts the fixing rotator, is coated with a slide facilitating material that facilitates sliding of the fixing rotator over the thermal equalizer.

2. The fixing device according to claim 1, wherein the nonlinear shape of the back face of the nip former includes a convex shape with respect to the support.

3. The fixing device according to claim 1, wherein the back face of the nip former includes a round portion that is not interrupted and is continuous.

4. The fixing device according to claim 3, wherein an entirety of the round portion of the back face of the nip former contacts the support.

5. The fixing device according to claim 1, wherein the nip former further includes a nip forming pad.

6. The fixing device according to claim 1, wherein the support includes a stay.

7. A fixing device comprising:

a fixing rotator that is flexible, endless, and rotatable;

a heater to heat the fixing rotator;

a pressure rotator disposed opposite the fixing rotator;

a nip former to define a fixing nip between the fixing rotator and the pressure rotator;

a support supporting the nip former, the support including a support face that supports the nip former and has a nonlinear shape in a longitudinal direction of the support; and a thermal equalizer interposed between the nip former and the fixing rotator, the thermal equalizer to equalize a temperature of the fixing rotator in an axial direction of the fixing rotator, wherein a surface of the thermal equalizer, which contacts the fixing rotator, is coated with a slide facilitating material that facilitates sliding of the fixing rotator over the thermal equalizer.

8. The fixing device according to claim 7, wherein the support supports the nip former directly.

9. The fixing device according to claim 7, wherein the nonlinear shape of the support face of the support includes a convex shape with respect to the pressure rotator.

10. The fixing device according to claim 7, wherein the support face of the support includes a round portion that is not interrupted and is continuous.

11. The fixing device according to claim 10, wherein an entirety of the round portion of the support face of the support contacts the nip former.

12. The fixing device according to claim 7, wherein a surface of the nip former, which contacts the fixing rotator, is coated with a slide facilitating material that facilitates sliding of the fixing rotator over the nip former.

13. An image forming apparatus comprising:

an image bearer to bear an image; and a fixing device to fix the image on a recording medium, the fixing device including:

a fixing rotator that is flexible, endless, and rotatable;

a heater to heat the fixing rotator;

a pressure rotator disposed opposite the fixing rotator;

a nip former to define a fixing nip between the fixing rotator and the pressure rotator; and a support supporting the nip former, the nip former including a back face that contacts the support and has a nonlinear shape in a longitudinal direction of the nip former; and a thermal equalizer interposed between the nip former and the fixing rotator, the thermal equalizer to equalize a temperature of the fixing rotator in an axial direction of the fixing rotator, wherein a surface of the thermal equalizer, which contacts the fixing rotator, is coated with a slide facilitating material that facilitates sliding of the fixing rotator over the thermal equalizer.

* * * * *